US008614407B2

(12) United States Patent
Kernwein et al.

(10) Patent No.: US 8,614,407 B2
(45) Date of Patent: Dec. 24, 2013

(54) METHOD FOR SUPPLYING CURRENT TO A GLOW PLUG

(75) Inventors: Markus Kernwein, Bretten-Buechig (DE); Peter Schaefer, Knittlingen (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 446 days.

(21) Appl. No.: 12/996,736

(22) PCT Filed: Jul. 1, 2009

(86) PCT No.: PCT/EP2009/004732

§ 371 (c)(1),
(2), (4) Date: Jan. 3, 2011

(87) PCT Pub. No.: WO2010/012344

PCT Pub. Date: Feb. 4, 2010

(65) Prior Publication Data

US 2011/0108540 A1 May 12, 2011

(30) Foreign Application Priority Data

Jul. 26, 2008 (DE) ..... 10 2008 035 039

(51) Int. Cl.
*F23Q 7/00* (2006.01)
*F02B 9/10* (2006.01)

(52) U.S. Cl.
USPC ..... 219/268; 219/497; 219/492; 219/493; 219/504; 219/505; 219/507; 219/509; 219/519; 123/145 R; 123/145 A; 123/179.1; 123/179.6; 123/179.3

(58) Field of Classification Search
USPC ..... 219/268, 497, 192–3, 504–5, 507, 509, 219/519; 123/145 R, 145 A, 179.1, 179.6, 123/179.3
See application file for complete search history.

(56) References Cited

U.S. PATENT DOCUMENTS

| | | | | |
|---|---|---|---|---|
| 4,669,430 | A * | 6/1987 | Reinold et al. | 123/179.6 |
| 2007/0227488 | A1 | 10/2007 | Gotou et al. | |
| 2010/0094523 | A1 | 4/2010 | Kernwein et al. | |

FOREIGN PATENT DOCUMENTS

| | | | |
|---|---|---|---|
| DE | 10 2004 016 856 | A1 | 10/2005 |
| DE | 10 2008 007 270 | A1 | 8/2009 |
| EP | 0 992 680 | A1 | 4/2000 |
| EP | 1 780 397 | A1 | 5/2007 |
| JP | 57018459 | A | 1/1982 |
| WO | 2006/009523 | * | 1/2006 |
| WO | WO 2006/009523 | A1 | 1/2006 |

* cited by examiner

*Primary Examiner* — Shawntina Fuqua
(74) *Attorney, Agent, or Firm* — Hackler Daghighian & Martino

(57) ABSTRACT

The invention relates to a method for supplying current to a glow plug in a running diesel engine after reaching the operating temperature thereof by a series of current pulses, wherein a piston of the engine carries out a work cycle comprising several strokes and the glow plug is supplied with current as a function of the strokes of the work cycle such that the electric current supplied in each work cycle is mainly supplied at a predetermined, steady stroke of the piston, wherein control time intervals that follow each other are defined, during which up to two switching processes can be triggered by a control device, by which the glow plug can be connected to a voltage source for creating a current pulse or can be disconnected from the voltage source for ending a current pulse. According to the invention, the control time intervals have a duration that can be varied by the control device as a function of the rotational speed of the engine.

13 Claims, 1 Drawing Sheet

METHOD FOR SUPPLYING CURRENT TO A GLOW PLUG

The invention is directed to a method for supplying current using a series of current pulses to a glow plug in a running diesel engine once the operating temperature thereof has been reached. A method having the features indicated in the preamble of claim 1 is known from EP 1 780 397 A1.

In such a method, the glow plug is supplied with current as a function of the strokes of the working cycle such that the electric current supplied in each working cycle is supplied mainly when the same predetermined stroke takes place. According to the teaching of EP 1 780 397 A1, current is supplied to glow plugs in a four-stroke engine during the intake phase, and the current supply is halted during the working cycle. Current is supplied during the intake phase using a series of pulse width modulated current pulses.

According to a method for pulse width modulation, a control device triggers up to two switching processes in one control time interval, by way of which a glow plug is connected to a voltage source to generate a current pulse, or is disconnected from the voltage source to end a current pulse.

By supplying glow plugs with current as a function of the strokes of the working cycle, combustion can be improved and the service life of the glow plugs can be extended.

The problem addressed by the invention is that of demonstrating a way to more easily supply current to glow plugs as a function of the strokes of the working cycle of the engine.

SUMMARY OF THE INVENTION

This problem is solved by a method having the features indicated in claim 1. Advantageous refinements of the invention are the subject matter of the dependent claims.

Instead of always using control time intervals having a constant duration and halting current flow entirely for a plurality of control intervals only as a function of the crankshaft angle, it is provided according to the invention for the control intervals to have a duration that is varied by the control device as a function of the rotational speed of the engine. In this manner, it is advantageously possible to supply current to a glow plug as a function of the strokes of the working cycle using fewer switching processes. Advantageously, the load on the control device is thus reduced since, according to the invention, fewer operations need be carried out per working cycle of the engine.

Basically, it is possible to synchronize the duration of the control time intervals with the duration of the working cycle, that is, to select the duration of the control intervals to always be equal to the duration of the momentary working cycle, thereby ensuring that exactly one current pulse is generated per working cycle, the beginning and/or end of which can always coincide with the same crankshaft angle.

Preferably, the duration of the control intervals is varied only in a stepwise manner in that the duration of the control time intervals is shortened when a predetermined rotational speed threshold is exceeded, and is extended when a predetermined rotational speed threshold is fallen below. The number of switching processes required to supply current to the glow plugs in a stroke-dependent manner can therefore also be kept low, advantageously, e.g. in particular when the control time intervals are shorter than the duration of the momentary working cycle but longer than half of the duration of one working cycle. By shifting the switch-on and switch-off times in the control time intervals, current pulses can be generated that cause current to be supplied to the glow plugs in a stroke-dependent manner, as desired. It is possible for a current pulse to start in one control time interval and not end until the subsequent control time interval, thereby ensuring that only one switching process takes place in one control time interval, under certain circumstances. To avoid unnecessary control time intervals, the duration thereof is preferably selected such that at least one switching process takes place in each control time interval.

The engine speed can be made available to a glow plug control device by an engine control unit. Engine control units typically determine engine speed anyway by monitoring the crankshaft angle, thereby ensuring that this information can be transmitted to the glow plug control device. It is also possible for the glow plug control device to monitor the engine speed itself by measuring the electrical resistance of the glow plug. When ignition occurs, combustion typically causes the glow plug to heat, thereby increasing resistance to a measurable extent. In this manner, the moment of ignition and, therefore, the crankshaft angle associated with the start of the working cycle can be determined.

Preferably, fewer than 8, preferably 2 to 5, rotational speed thresholds are specified, which, when exceeded, result in the duration of the control time intervals being shortened. If the rotational speed thresholds for extending the control time intervals deviate from the rotational speed thresholds for shortening the control time intervals, then preferably fewer than 8, preferably 2 to 5, rotational speed thresholds are specified, which, when fallen below, result in the duration of the control time intervals being extended. Preferably the predetermined rotational speed thresholds that, when exceeded, result in the duration of the control time intervals being shortened differ from the predetermined rotational speed thresholds that, when fallen below, result in the duration of the control time intervals being extended, and in fact differ by less than 10%, in particular by less than 5%, that is, are equal except for a low hysteresis which is intended to increase the stability of the system.

In this context, it is preferable that the duration of the control time interval for rotational speeds below the lowest rotational speed threshold is an integer multiple of the duration of the control time interval for rotational speeds above the highest rotational speed threshold.

The invention also relates to a control device that carries out a method according to the invention during operation.

BRIEF DESCRIPTION OF THE DRAWINGS

Further details and advantages of the invention are explained using an embodiment, with reference to the attached drawings. In the drawings.

DETAILED DESCRIPTION

Figure 1:
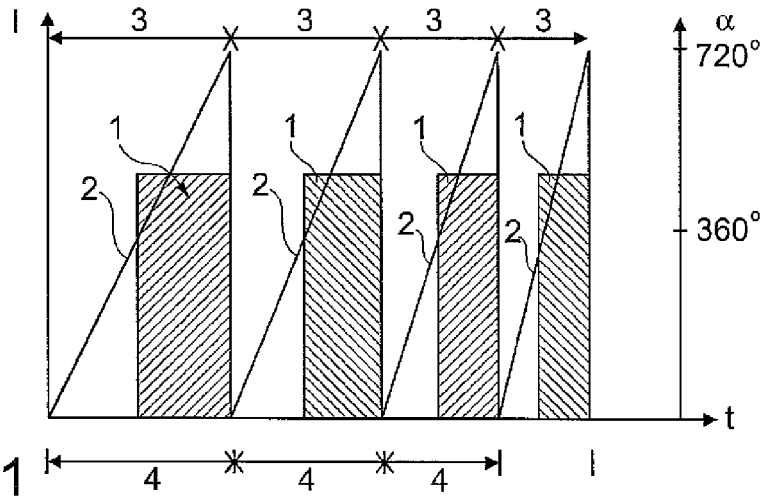
FIG. 1 shows a schematic depiction of the course of the current pulses and the crankshaft angle with continuous adaptation of the duration of the control time intervals to the duration of the working cycle.

In FIG. 1, current pulses 1 over time t are shown as shaded rectangles, wherein the ordinate on the left indicates current intensity I in arbitrary units. In addition, crankshaft angle $\alpha$ is indicated as a function of time using slanted lines 2, wherein the ordinates on the right represent the value of crankshaft angle α in degrees. The beginning and the end of slanted lines 2 mark the beginning and the end of one working cycle 3 of the engine piston.

Since, in a four-stroke engine, one working cycle 3 includes two rotations of the crankshaft, values of crankshaft angle α are presented from 0° to 720° in FIG. 1. In FIG. 1, a crankshaft angle α of 0° corresponds to the start of the working cycle i.e. the moment of ignition.

Current pulses 1 are generated by a control device triggering switching processes that cause a glow plug to be connected to the electrical system of a vehicle, or to be disconnected therefrom. A current pulse 1 is started by the control device using a switching process to switch a power transistor to the conducting state thereof. A current pulse 1 is ended by the control device switching the power transistor to the blocked state thereof.

The control device specifies consecutive control time intervals 4. In each control time interval up to two switching procedures can be triggered, by way of which the glow plug is connected to a voltage source to generate a current pulse, or is disconnected from the voltage source to end a current pulse. The start and the end of control time intervals 4 are indicated in FIG. 1 using marks underneath the abscissa. As shown, the duration of control time intervals 4 is always the same as the duration of particular working cycle 3.

The glow plug control device receives data from an engine control unit about the crankshaft angle and selects the duration of control time intervals 4 accordingly, thereby synchronizing them with working cycle 3. It is also possible for the glow plug control device to determine crankshaft angle α itself by measuring the temperature-dependent resistance of the glow plug. That is to say, the temperature of a glow plug undergoes measurable fluctuations during working cycle 3 that make it possible to determine the moment of ignition. During ignition and subsequent combustion of the fuel mixture, the glow plug is heated by combustion energy. This induces a measurable increase in the electrical resistance of the glow plug, thereby making it possible to determine the moment of ignition and, therefore, the crankshaft angle by evaluating the moment of resistance.

In the embodiment shown in FIG. 1, a current pulse 1 always starts at the same crankshaft angle and always ends at the same crankshaft angle i.e. after half of working cycle 3. The end of a current pulse 1 therefore coincides with the ignition of the fuel mixture in the combustion chamber. It is particularly advantageous for a current pulse to end when the fuel mixture is ignited since this prevents the glow plug from overheating.

Figure 2A:
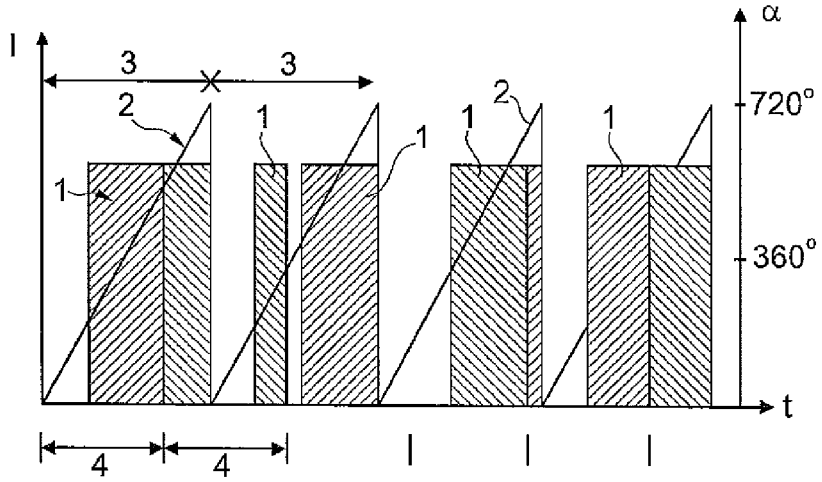
FIG. 2*a* shows the course of the current pulses and the crankshaft angle with a stepwise change in the duration of the control time intervals, in a first rotational speed range.
Figure 2B:
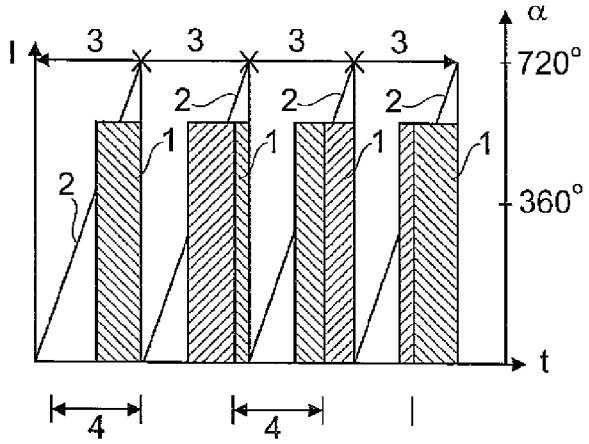
FIG. 2*b* shows the course of the current pulses and the crankshaft angle with a stepwise change in the duration of the control time intervals, in a second rotational speed range.

In FIGS. 2*a* and 2*b*, current pulses 1, crankshaft angle α, and the limits of control time intervals 4 for an alternative method are indicated, according to which the duration of control time intervals 4 is adapted in a stepwise manner to a change in the rotational speed of the crankshaft. In FIGS. 2*a* and 2*b*, the duration of control time intervals 4 therefore deviates from the duration of particular working cycle 3. FIG. 2*a* shows the relationships in a lower rotational speed range, and FIG. 2*b* shows the relationships in an upper rotational speed range. The duration of control time intervals 4 is always such that it is shorter than the duration of momentary working cycle 3 and is greater than half of the duration of momentary working cycle 3.

If the rotational speed exceeds predetermined threshold values, the duration of control time intervals 4 is shortened, as shown in the right half of FIG. 2. In a corresponding manner, the duration of control time intervals 4 is extended when a predetermined rotational speed threshold is fallen below. Preferably, fewer than 8, in particular 2 to 5 rotational speed thresholds are specified. It is advantageous to select the rotational speed thresholds that, when exceeded, result in the duration of the control time intervals being shortened, and the rotational speed thresholds that, when fallen below, result in the duration of control time intervals 4 being extended, to be equal, although this is not absolutely necessary.

In the embodiment depicted in FIGS. 2*a* and 2*b*, only a single switching process takes place in a few control time intervals 4. For example, in first control time interval 4 shown in FIG. 2*a*, a current pulse 1 is started, which is ended by a switch-off process in subsequent control time interval 4. To emphasize the limits of control time intervals 4, the shading of current pulses 1 differs in adjacent control time intervals.

At least one switching process takes place in each control time interval 4. Current is always supplied to the glow plug during a portion of the duration of a control time interval 4. The magnitude of this portion is determined by the glow plug control device on the basis of the energy quantity to be supplied to the glow plug per control time interval 4, so that the glow plug has a desired temperature e.g. during ignition.

To enable current to flow in a stroke-dependent manner, suitable points in time are selected for the switching processes carried out by the glow plug control device in the individual control time intervals 4, thereby ensuring that the desired quantity of energy is supplied to the glow plug in every control time interval 4.

| Reference numerals | |
|---|---|
| α | Crankshaft angle |
| t | Time |
| I | Current |
| 1 | Current pulse |
| 2 | Course of crankshaft angle α |
| 3 | Working cycle |
| 4 | Control time interval |

The invention claimed is:

1. A method for supplying a series of current pulses to a glow plug in a running diesel engine after an operating temperature of the glow plug has been reached and wherein a piston of the engine carries out a working cycle comprising a plurality of strokes, the method comprising:

supplying the glow plug with current as a function of the stroke of the working cycle in order that electric current supplied in each working cycle is supplied when a same predetermined stroke of the piston takes place;

defining sequential control time intervals during which up to two switching processes can be triggered by a control device, for enabling the glow plug to be connected to a voltage source, in order to generate a current pulse, and disconnected from the voltage source to end a current pulse, the control time intervals having a duration variable by the control device as a function of the rotational speed of the engine, wherein the duration of the control time intervals is varied in a stepwise manner in that the duration of the control time intervals is shortened when a predetermined rotational speed threshold is exceeded, and is extended when a predetermined rotational speed threshold is fallen below.

2. The method according to claim 1, further comprises providing a predetermined rotational speed thresholds that, when exceeded, results in reducing the duration of the control time intervals by less than 10% from a predetermined rotational speed thresholds that, when fallen below, result in the duration of the control time intervals being increased.

3. The method according to claim 1, wherein fewer than 8 rotational speed thresholds are specified, which, when exceeded, result in the duration of the control time intervals being shortened.

4. The method according to claim 1, wherein 3 to 5 rotational speed thresholds are specified, which, when exceeded, result in the duration of the control time intervals being shortened.

5. The method according to claim 1, wherein the duration of the control time interval for rotational speeds below the lowest rotational speed threshold is an integer multiple of the duration of the control time interval for rotational speeds above the highest rotational speed threshold.

6. The method according to claim 1, wherein the duration of each of the control time intervals is longer than one stroke of the current working cycle.

7. The method according to claim 1, wherein the duration of each of the control time intervals is shorter than the duration of the current working cycle.

8. The method according to claim 1, wherein the duration of each of the control time intervals is longer than half of the duration of the current working cycle.

9. The method according to claim 1, wherein the current pulses are timed such that a current pulse always ends in the working cycles at the same crankshaft angle.

10. The method according to claim 1, wherein the current pulses are timed such that a current pulse ends when the fuel mixture is ignited.

11. The method according to claim 1, wherein at least one switching process for starting or ending a current pulse takes place in one control time interval.

12. A method for supplying a series of current pulses to a glow plug in a running diesel engine after an operating temperature of the glow plug has been reached and wherein a piston of the engine carries out a working cycle comprising a plurality of strokes, the method comprising:

supplying the glow plug with current as a function of the stroke of the working cycle in order that electric current supplied in each working cycle is supplied when a same predetermined stroke of the piston takes place;

defining sequential control time intervals during which up to two switching processes can be triggered by a control device, for enabling the glow plug to be connected to a voltage source, in order to generate a current pulse, and disconnected from the voltage source to end a current pulse, the control time intervals having a duration variable by the control device as a function of the rotational speed of the engine, wherein the current pulses are timed such that a current pulse always ends in the working cycles at the same crankshaft angle.

13. A method for supplying a series of current pulses to a glow plug in a running diesel engine after an operating temperature of the glow plug has been reached and wherein a piston of the engine carries out a working cycle comprising a plurality of strokes, the method comprising:

supplying the glow plug with current as a function of the stroke of the working cycle in order that electric current supplied in each working cycle is supplied when a same predetermined stroke of the piston takes place;

defining sequential control time intervals during which up to two switching processes can be triggered by a control device, for enabling the glow plug to be connected to a voltage source, in order to generate a current pulse, and disconnected from the voltage source to end a current pulse, the control time intervals having a duration variable by the control device as a function of the rotational speed of the engine, wherein the current pulses are timed such that a current pulse ends when the fuel mixture is ignited.

* * * * *